United States Patent [19]

Higuchi et al.

[11] Patent Number: 4,660,521

[45] Date of Patent: Apr. 28, 1987

[54] APPARATUS FOR CHANGING THE FREQUENCY OF A DYNAMO ENGINE

[75] Inventors: Masaaki Higuchi, Ohmiya; Masaru Atsuumi, Saitama, both of Japan

[73] Assignee: Fuji Jukogyo Kabushiki Kaisha, Tokyo, Japan

[21] Appl. No.: 842,322

[22] Filed: Mar. 21, 1986

[30] Foreign Application Priority Data

Apr. 2, 1985 [JP] Japan ..... 60-49593

[51] Int. Cl.[4] ..... F02D 31/00

[52] U.S. Cl. ..... 123/376; 123/400

[58] Field of Search ..... 123/376, 400, 403

[56] References Cited

U.S. PATENT DOCUMENTS

| | | | |
|---|---|---|---|
| 2,803,757 | 8/1957 | McFarland | 123/376 |
| 2,837,070 | 6/1958 | Agar | 123/376 |
| 3,749,069 | 7/1973 | Reese | 123/376 |
| 4,517,942 | 5/1985 | Pirkey et al. | 123/376 |
| 4,569,321 | 2/1986 | Bonfiglioli et al. | 123/376 |

FOREIGN PATENT DOCUMENTS

| | | | |
|---|---|---|---|
| 85437 | 5/1984 | Japan | 123/376 |
| 58108245 | 7/1985 | Japan . | |

*Primary Examiner*—William A. Cuchlinski, Jr.
*Attorney, Agent, or Firm*—Martin A. Farber

[57] ABSTRACT

A speed control lever is provided to position a throttle valve at a first position for providing a low engine speed for a low frequency output from a generator driven by the engine, and an operating lever is rotatably provided. A spring is provided to urge the operating lever in opposite directions with respect to a neutral position. When the operating lever is rotated in one of the directions, the lever engages with the speed control lever to rotate the speed control lever to a second position for providing a high engine speed for a high frequency output from the generator.

4 Claims, 4 Drawing Figures

APPARATUS FOR CHANGING THE FREQUENCY OF A DYNAMO ENGINE

BACKGROUND OF THE INVENTION

The present invention relates to an apparatus for changing the frequency of a dynamo engine, and more particularly to an apparatus for changing a frequency (for example 50 Hz) of alternating current to another frequency (for example 60 Hz), and vice versa, in accordance with a local commercial frequency.

The apparatus for changing the frequency is adapted to change the speed of an engine for the change of the frequency. Such an apparatus must be arranged to keep the output voltage of the generator constant in spite of the change of frequency. Japanese Utility Model Laid Open 58-108245 discloses an apparatus for changing the frequency of a dynamo engine. The apparatus has an operating lever which is manipulated by an operator to change the engine speed. More particularly, the operating lever is connected to a governor lever through a coil spring. When the operating lever is rotated a predetermined angle, the governer lever is rotated, so that a throttle valve of an engine is rotated to change the engine speed. At the same time, a switch for a generator is operated to keep the output voltage constant. The operating lever is rotated by switching of spring operating direction, when the lever passes the neutral point where the longitudinal direction of the lever coincides with the extending direction of the spring. However, there is no definite and sharp switching point at the neutral point, since the road of the spring is light, which means inferiority of operability.

In addition, since engine speeds for both frequencies are adjusted by adjusting the rotating angle of the operating lever, the rotating angle can not be set to a constant value. If the rotating angle becomes too large to operate the switch, a rated voltage can not be generated.

SUMMARY OF THE INVENTION

The object of the present invention is to provide an apparatus for changing the frequency, which has improved operability and in which the rotating angle of an operating lever is constant, whereby a switch for a generator can be surely operated.

According to the present invention, there is provided an apparatus for changing the frequency of a generator driven by an engine, the engine having a carburetor with a throttle valve and a governer lever operatively connected to the throttle valve so as to rotate the throttle valve. The apparatus comprises a speed control lever rotatably provided on a supporting member, first means for positioning the speed control lever at a first position, a governer spring provided between the governer lever and the speed control lever so as to urge the speed control lever to the first position, an operating lever rotatably provided on the supporting member, a second spring provided between the operating lever and the supporting member so as to urge the operating lever in opposite rotational directions with respect to a neutral position, second means for positioning the operating lever at a second position in one of rotational directions, third means for positioning the operating lever at a third position in the other rotational direction, fourth means for engaging the operating lever and the speed control lever with each other during the rotation of the operating lever in the other rotational direction.

In an aspect of the present invention, the first means comprises an adjust screw provided on the supporting member, and an engaging portion formed on the speed control lever, and each of the second and third means comprises an end portion formed on the operating lever and an engaging portion formed on the supporting member. The fourth means comprises an adjust screw provided on the operating lever and an engaging portion formed on the speed control lever.

The other objects and features of this invention will be apparently understood from the following description with reference to the accompanying drawings.

DETAILED DESCRIPTION OF THE PREFERRED EMBODIMENT

Figure 1:
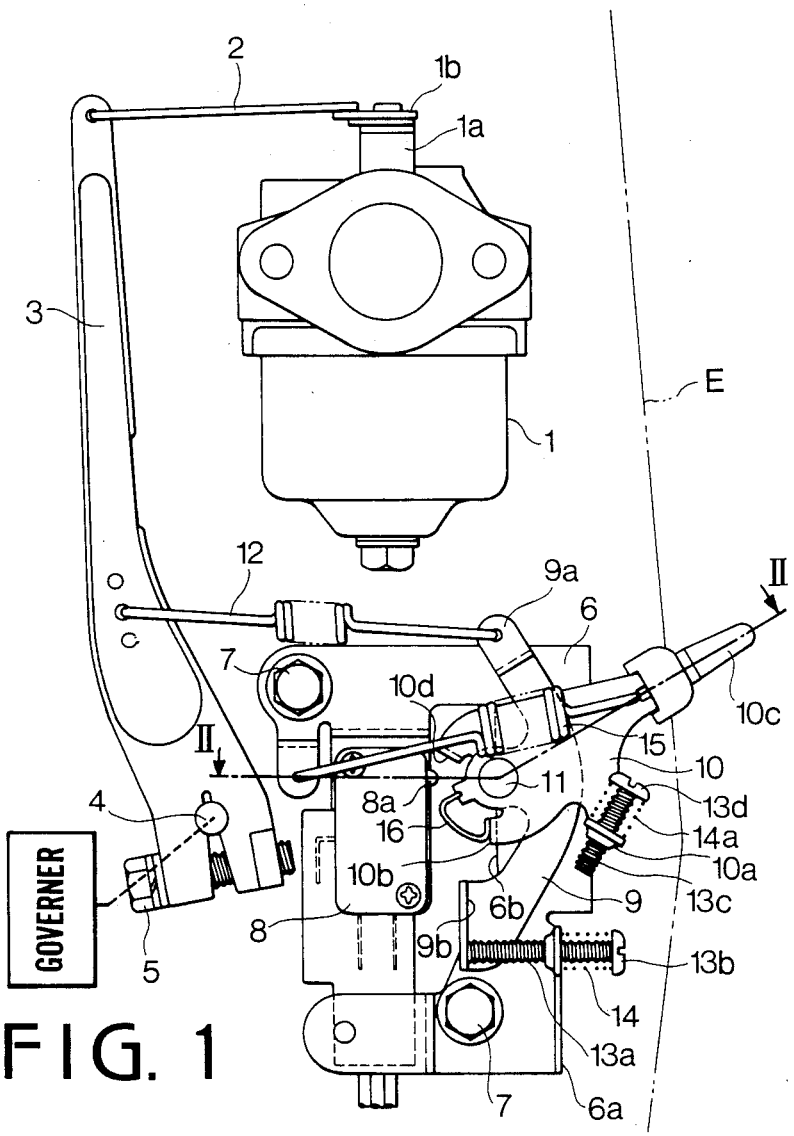
FIG. 1 is a side view showing an apparatus according to the present invention.
Figure 2:
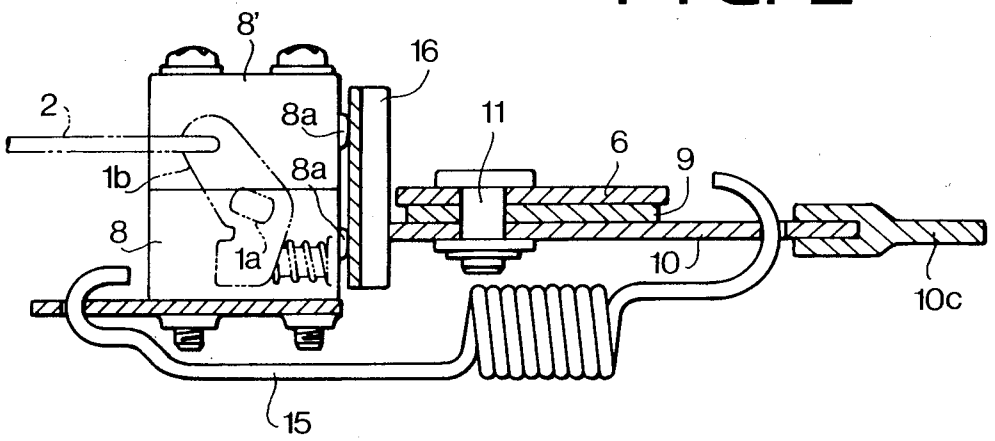
FIG. 2 is a sectional view taken along a line II—II of FIG. 1.

Referring to FIGS. 1 and 2, an engine E of a dynamo engine has a carburetor 1 having a throttle valve (not shown). Secured to the valve is a throttle shaft 1*a* which has a throttle lever 1*b* secured thereto. The throttle lever 1*b* is operatively connected to a governer lever 3 through a governer rod 2. The governer lever 3 is secured to a governer shaft 4 by a bolt 5. The governer shaft 4 is operatively connected to a centrifugal weight device of a governer G. The governer lever 3 is urged in the counter clockwise direction by the operation of governer G during the operation of the dynamo engine.

On the other hand, a speed control lever 9 and an operating lever 10 are rotatably mounted on a shaft 11 secured to a supporting plate 6 which is attached to a body of the engine E by bolts 7. An end of the speed control lever 9 is connected to a portion of governer lever 3 by a governer spring 12. An engaging bent end 9*b* at another end of the lever abuts on an end of an adjusting screw 13*a* by the spring 12 during the operation of the dynamo engine. The adjust screw 13*a* is screwed in a bracket 6*a* formed by bending a part of the supporting plate 6, and a spring 14 is provided between a head 13*b* of the screw and bracket 6*a* so as to prevent the screw from loosening. Thus, the levers 9, 3 and 1*b* are positioned to locate the throttle valve at a position for a rated speed, for example 3000 rpm for the frequency of 50 Hz.

A coil spring 15 is provided between a portion of the operating lever 10 and a portion on the supporting plate 6, both portions being at opposite sides of the shaft 11. The lever 10 has engaging bent ends 10*b* and 10*d*, and a knob 10*c*. An adjust screw 13*c* is screwed in a bracket 10*a* formed by bending a part of the lever 10, and a spring 14*a* is disposed between a head 13*d* of the screw and the bracket 10*a* for preventing loosening of the screw 13*c*. At the position of the operating lever 10 shown in FIG. 1, the bend end 10*b* abuts on an inside wall of an opening 6*b* formed in the supporting plate 6, and an actuating member 16 made of spring plate does not engage with actuating rods 8*a* of a pair of switches 8 and 8' mounted on supporting plate 6.

Figure 4:
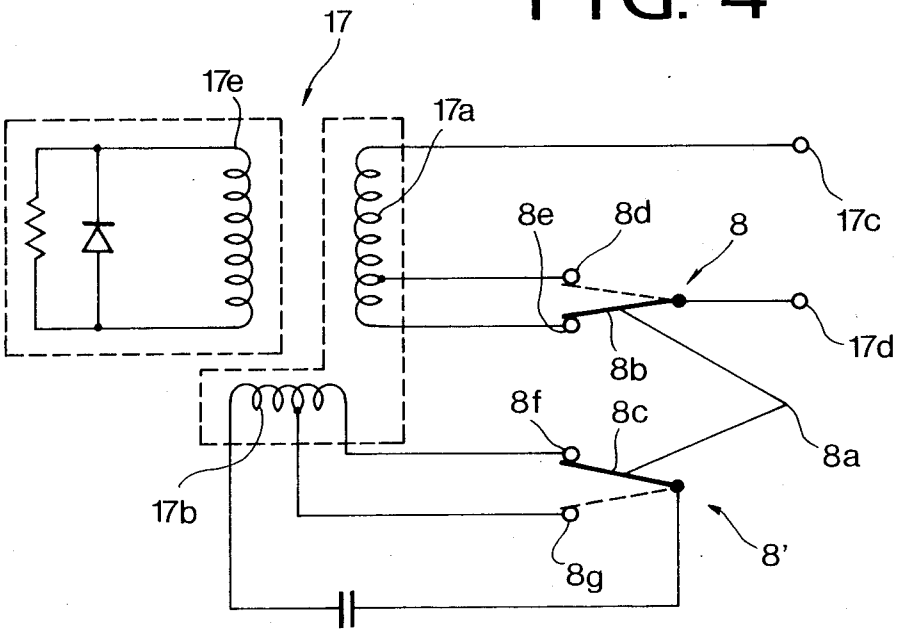
FIG. 4 is a circuit for a switch of a generator.

As shown in FIG. 4, the switch 8 comprises a movable contact 8*b* and fixed contacts 8*d* and 8*e*, and switch 8′ comprises a movable contact 8*c and fixed contacts 8f and 8g*. A generator 17 comprises an armature winding 17*a* having an intermediate tap, capacitor winding 17*b* with an intermediate tap, field winding 17*e*, output terminal 17*c* and output terminal 17*d* which is selectively connected to fixed contacts 8*d* and 8*e* by movable contact 8*b*.

At the state of the apparatus shown in FIGS. 1 and 4, the engine speed is at a low speed (3000 rpm) for a low frequency (50 Hz) at a rated voltage (100 V).

Figure 3:
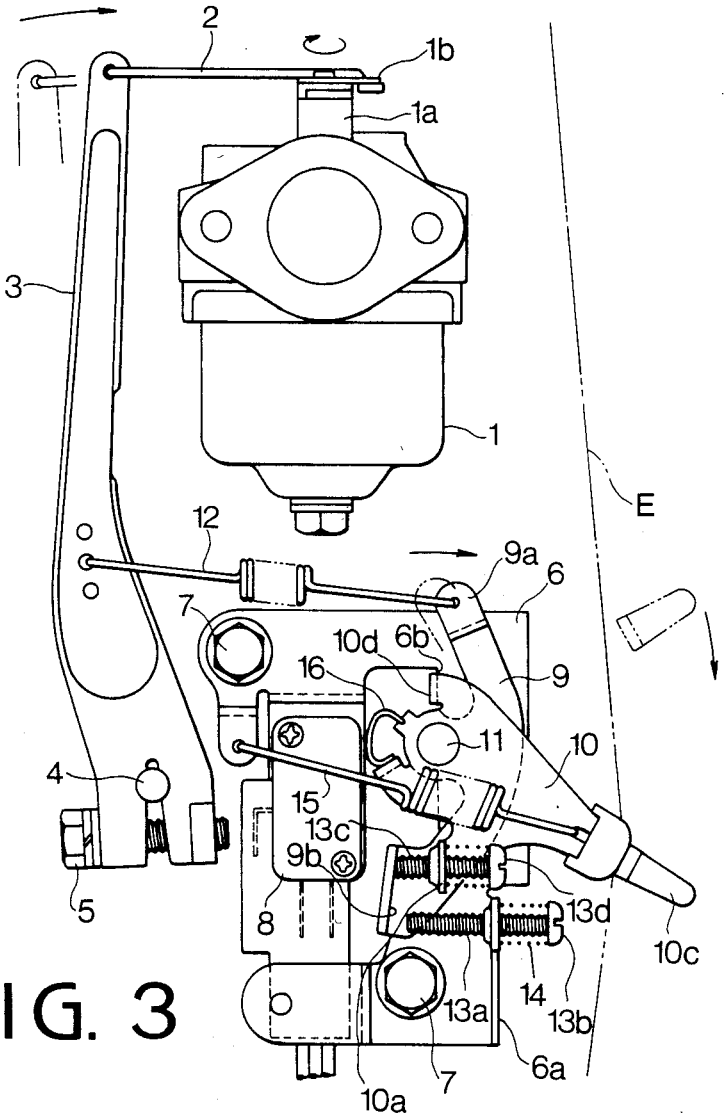
FIG. 3 is a side view of the apparatus when a frequency is changed to another frequency.

When the operating lever 10 in FIG. 1 is rotated in the clockwise direction about the shaft 11 by an operator, the load of spring 15 becomes maximum at the neutral position where the longitudinal direction of the lever 10 coincides with the extending direction of spring 15. When the lever passes the neutral position, the spring operating direction changes so that lever 10 is quickly rotated by the compression force of the spring 15. As shown in FIG. 3, the lever 10 is stopped by engagement of bent end 10*d* with the inside wall of the opening 6*b*, and the actuating member 16 pushes the actuating rods 8*a* of switches 8 and 8′. During the rotation of the lever 10, the adjust screw 13*c* engages with the bent end 9*b* of the speed control lever 9 to rotate it in the clockwise direction, so that governer lever 3 is rotated in the clockwise direction through governer spring 12, thereby rotating the throttle shaft 1*a* to open the throttle valve. Thus, the engine speed is increased, for example to 3,600 rpm for high frequency of 60 Hz. On the other hand, movable contacts 8*b* and 8*c* engage with fixed contacts 8*d* and 8*g* as shown by dotted line in FIG. 4, thereby keeping the output voltage at output terminals 17*c* and 17*d* at a constant value (100 V).

When the operating lever is rotated in the counter clockwise direction from the position shown in FIG. 3, the speed control lever 9 is rotated in the counter clockwise direction from the position of FIG. 3 to the position of FIG. 1. This, engine speed reduces to a low frequency speed.

In order to adjust the engine speed to 3,000 rpm, the adjust screw 13*a* is rotated by a screwdriver in the state of FIG. 1, and in order to adjust to 3,600 rpm, the adjust screw 13*c* is rotated in the state of FIG. 3. Since both adjust screws are positioned in the same direction at the adjustment, adjusting operation is very easy.

Adjust screws 13*a* and 13*c* may be provided on the speed control lever 9 and stoppers may be provided on the supporting plate 6 and on the operating levers 10 so as to be engaged therewith, respectively.

From the foregoing it will be understood the present invention provides an apparatus in which the rotating angle of an operating lever can be set to a constant angle, ensuring the operation of a switch. Further, since the spring 15 is not connected to the governer lever 3, the load of the spring can be increased. Accordingly, it is possible to provide a sharp switching point in the motion of the operating lever.

While the presently referred embodiment of the present invention has been shown and described, it is to be understood that this disclosure is for the purpose of illustration and that various changes and modifications may be made without departing from the scope of the invention as set forth in the appended claim.

What is claimed is:

1. An apparatus for changing the frequency of an engine for driving a generator, the engine having a carburetor with a throttle valve and a governer lever operatively connected to a governer and to the throttle valve so as to rotate the throttle valve, the apparatus comprising:

a speed control lever rotatably provided on a supporting member;

first means for positioning the speed control lever at a first position;

a governer spring connected to the governer lever and the speed control lever so as to urge the speed control lever to the first position;

an operating lever rotatably provided on the supporting member;

a spring provided between the operating lever and the supporting member so as to urge the operating lever in opposite rotational directions with respect to a neutral position;

second means for positioning the operating lever at a second position in one of rotational directions;

third means for positioning the operating lever at a third position in the other rotational direction;

fourth means for engaging the operating lever and the speed control lever with each other during the rotation of the operating lever in the other rotational direction.

2. The apparatus according to claim 1 wherein the first means comprises an adjust screw provided either of the speed control lever or the supporting plate, and an engaging portion formed on the other one.

3. The apparatus according to claim 1 wherein each of the second and third means comprises an end portion formed on the operating lever and an engaging portion formed on the supporting member.

4. The operating according to claim 2 wherein the fourth means comprises an adjust screw provided on either of the operating lever or the speed control lever, and an engaging portion formed on the other lever.

* * * * *